United States Patent [19]

Landon, Jr.

[11] 4,013,470

[45] Mar. 22, 1977

[54] WARM IMAGE TONE PROVIDING PHOTOGRAPHIC ELEMENT

[75] Inventor: John T. Landon, Jr., Sao Paulo, Brazil

[73] Assignee: Eastman Kodak Company, Rochester, N.Y.

[22] Filed: Dec. 3, 1975

[21] Appl. No.: 637,248

[30] Foreign Application Priority Data

May 29, 1975 United Kingdom ..... 23478/75

[52] U.S. Cl. ..... 96/95; 96/114.6

[51] Int. Cl.[2] ..... G03C 1/06; G03C 1/02

[58] Field of Search ..... 96/95, 114.6, 52

[56] References Cited

UNITED STATES PATENTS

| | | | |
|---|---|---|---|
| 3,155,519 | 11/1964 | Blake | 96/114.6 |
| 3,615,490 | 10/1971 | Gaffin | 96/114.6 |

FOREIGN PATENTS OR APPLICATIONS

| | | | |
|---|---|---|---|
| 401,231 | 2/1970 | Australia | 96/95 |
| 912,258 | 12/1962 | United Kingdom | 96/29 |

*Primary Examiner*—Mary F. Kelley

*Attorney, Agent, or Firm*—C. O. Thomas

[57] ABSTRACT

A photographic element containing an incorporated developing agent is disclosed which forms a photographic print having a warm image tone upon successive processing in an alkaline activator bath and a stabilizer bath. The element is comprised of a reflective nonporous support bearing a silver halide emulsion layer which forms a viewable silver image therein upon processing. The emulsion layer contains an azaindene antifoggant. The element additionally contains in or adjacent the emulsion layer a warm image tone providing mixture of a quaternary ammonium salt and a silver salt of a heterocyclic mercaptan.

16 Claims, No Drawings

WARM IMAGE TONE PROVIDING PHOTOGRAPHIC ELEMENT

This invention relates to photographic elements which form photographic prints upon successive processing in an activator bath and a stabilizer bath.

In the photographic art many compounds have been proposed for modifying the tone of the photographic image obtained following exposure and processing of a photographic element containing a silver halide emulsion layer. British Pat. No. 1,076,781 teaches forming photographic images of warmer tone through the incorporation of certain bis-pyridinium compounds wherein the pyridinium nuclei are joined by 6 or more atoms, all of which are carbon atoms or some are carbon atoms and the remainder oxygen atoms.

British Pat. No. 1,004,302 teaches the incorporation of a 5-mercapto-tetrazole or its silver salt in a photographic silver halide emulsion for the purpose of changing the image color from a warm brownish-black to a colder bluish-black. British Pat. No. 1,269,963 teaches incorporating in an overcoat layer a triazole cold toning agent and a silver salt of a mercaptotetrazole with the result of producing very cold image tones in a silver halide photographic element.

British Pat. No. 912,258 is directed to a silver salt diffusion transfer process in which a silver halide emulsion layer is developed in the presence of a silver halide solvent. The emulsion layer is in contact with a receiver sheet which carries a silver precipitant so that a silver image is formed on development on the receiver sheet. To offset the formation of warm image tones it is taught to employ onium compounds, such as quaternary ammonium salts, and a variety of silver salt forming chalcogen compounds, such as heterocyclic mercaptans, for the purpose of shifting the silver image from brown to black. This changes the tone of the positive receiver image obtained from warm brown to a colder, neutral black color. The tone modifying compounds can be located in the processing solution or in the emulsion layer, and the emulsion layer can additionally contain other addenda, such as azaindene antifoggants silver halide developing agents, spectral sensitizers, and the like.

It is additionally known in the photographic arts to produce photographic prints by incorporating in a photographic element prior to processing a developing agent. The photographic element can then be processed by successive contact with an activator and a stabilizer. Photographic elements capable of processing in this manner are disclosed in British Pat. Nos. 1,004,302, cited above, and 1,139,063, for example.

According to the present invention there is provided a photographic element which forms a photographic print upon successive processing in an alkaline activator bath and a stabilizer bath, comprising a reflective non-porous support, a silver chlorobromide emulsion layer which forms a viewable continuous tone silver image therein upon processing containing an azaindene antifoggant and an incorporated silver halide developing agent and a warm image tone providing mixture of a quaternary ammonium salt and a silver salt of a heterocyclic mercaptan.

It has been discovered that photographic elements of the invention exhibit desirably warm image tones, are stabilized against fog and can be processed using an alkaline activator bath and a stabilizer bath.

The quaternary ammonium salts can be chosen from among those known in the photographic arts to be compatible with photographic silver halide emulsions. The quaternary ammonium salts include organic quaternary ammonium salts, such as aliphatic and heterocyclic organic quaternary ammonium salts.

Exemplary of aliphatic organic ammonium salts are tetraalkyl quaternary ammonium salts having the general formula

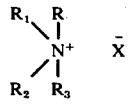

in which X is an anion or acid radical, for example, halide, p-toluene sulfonate, alkyl sulfate or perchlorate, R, $R_1$, $R_2$ and $R_3$ are alkyl groups of which at least one has a chain of seven or more atoms such as carbon atoms, carbon atoms plus oxygen atoms, sulfur atoms or nitrogen atoms and ring systems, while the remaining R groups are alkyl such as methyl, ethyl, butyl, benzyl and the like.

In addition, the quaternary nitrogen atom may be linked through one of the R groups to a second quaternary nitrogen atom as in the bis-quaternary ammonium salts having the general structure

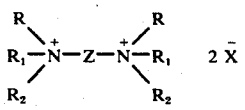

wherein R, $R_1$ and $R_2$ are as just mentioned and Z represents a bivalent organic radical such as the following, for example:

$-CH_2-CH_2-$
ethylene
$-CH_2-(CH_2)_8-CH_2-$
decamethylene
$-CH_2-O-CH_2-(CH_2)_8-CH_2-O-CH_2-$
decamethylene-bis-oxymethyl
$-CH_2-O-CH_2-CH_2-O-CH_2$
ethylene-bis-oxymethyl
$-(CH_2-CH_2-O)_n-CH_2-CH_2-$
(wherein n represents a positive integer)

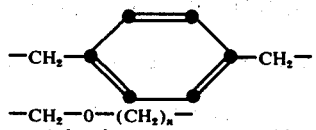

$-CH_2-O-(CH_2)_n-$
(wherein n represents a positive integer)
$-CH_2-O-CH_2-CH_2-S-CH_2-CH_2-O-CH_2-$
$-CH_2-CO-CO-CH_2-$
$-CH_2-CH_2-S-CH_2-CH_2-$

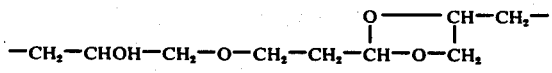

The organic radical can also contain nitrogen. Ammonium salts of this type are disclosed in British Pat. Nos. 558,710 and 912,258.

Exemplary of heterocyclic organic ammonium salts are quaternary ammonium salts in which the quaternary nitrogen atom is a part of a ring system and which have the general formula

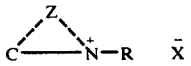

where X is as above mentioned and R represents a chain of at least seven atoms and Z represents the atoms necessary to complete a cyclic structure such as a pyridyl, α-picolyl, piperidyl or morpholinyl nucleus. R may contain a second quaternary nitrogen atom as present in the bis-quaternary ammonium compounds having the structure

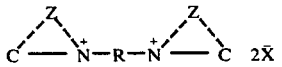

Illustrative of specific, preferred quaternary ammonium salts useful in the practice of this invention are the following:

QS-1 Decamethylene-αbis(ovymethylpyridinium) perchlorate)
QS-2 Laurylpyridinium perchlorate
QS-3 Decamethylene-bis-(oxymethyl-α-picolinium perchlorate)
QS-4 p-Xylylene-bis-(pyridinium perchlorate)
QS-5 Hexamethylene-bis(oxymethylpyridinium perchlorate)
QS-6 Hexadecylpyridinium chloride
QS-7 Decamethylene-bis(oxymethyldimethylbenzylammonium perchlorate)
QS-8 Decamethylene-bis(N-methylpiperidinium perchlorate)
QS-9 Lauryl pyridinium-p-toluenesulfonate
QS-10 N-n-tetradecyl-N-methylnorpholinium-p-toluene sulfonate
QS-11 Lauryl trimethylammonium-p-toluene sulfonate
QS-12 n-Myristyl-trimethylammonium-p-toluene sulfonate
QS-13 Decamethylene-bis-trimethylammonium bromide
QS-14 Decamethylene-bis-triethylammonium perchlorate
QS-15 Tetradecamethylene-bis(pyridinium perchlorate)
QS-16 1,1'-[ethylene bis-(oxymethylene)]-bis pyridinium chloride
QS-17 N,N'-ethylene bis-(oxymethyl pyridinium perchlorate
QS-18 7,14-diaza-6,15-dioxaeicosane-1,20-bis-(pyridinium perchlorate)
QS-19 3,6,9,12,15,18,21,24-octaoxahexacosane bis-(pyridinium perchlorate)
QS-20 7,18-diazi-6,19-dioxatetracosane-1,24-bis(-pyridinium perchlorate)
QS-21 3,6,9,12,15,18,24-octaoxahexacosane-1,26-bis(5-ethyl-2-methyl pyridinium methylsulfonate)
QS-22 7,13-dithianonadecane-1,19-bis(pyridinium p-toluene sulfonate)
QS-23 3,8-dithiadecane-1,10-bis(N-methyl piperidinium p-toluene sulfonate)
QS-24 1,1'-ethylene-bis(pyridinium perchlorate)
QS-25 carboxydecane-1-pyridinium perchlorate The silver salts of heterocyclic mercaptans employed in combination with the quaternary ammonium salts can be of any type known in photography to be compatible with photographic silver halide emulsions. In a preferred form the heterocyclic mercaptans can be represented by the general formula

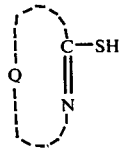

wherein Q represents the atoms necessary to complete a five or six membered heterocyclic nucleus. The ring-forming atoms of the heteocyclic nucleus are preferably chosen from among carbon, oxygen, nitrogen and sulfur atoms. Exemplary preferred heterocyclic nuclei include tetrazole, thiazole, triazole, oxadiazole, imidazole, pyrimidine, uramil, triazine, tetrazaindene, thiadiazole and similar ring structures.

Illustrative of specific, preferred heterocyclic mercaptans useful in the form of silver salts in the practice of this invention are the following:

M-1 1-phenyl-5-mercaptotetrazole
M-2 1-phenyl-2-mercaptotetrazole
M-3 2-mercapto-5-phenyl-1,3,4-oxadiazole
M-4 2-mercapto-5-(p-hydroxyphenyl)-1,3,4-oxadiazole
M-5 2-mercapto-5-furyl-1,3,4-thiadiazole
M-6 2-mercapto-5-amino-1,3,4-thiadiazole
M-7 2,6-dimethyl-1,3,3a,7-tetrazaindene-4-thiol
M-8 5-ethyl-6-methyl-1,2,3a,7-tetrazaindene-4-thiol
M-9 5-t-butyl-6-methyl-1,2,3a,7-tetrazaindene-4-thiol
M-10 4-methyl-1,2,3a,7-tetrazaindene-6-thiol
M-11 5-bromo-6-methyl-1,3,3a,7-tetrazaindene-4-thiol
M-12 4-hydroxy-6-methyl-1,2,3a,7-tetrazaindene-3-thiol
M-13 5-phenyl-1,2,3a,4-tetrazaindene-7-thiol
M-14 5-methyl-1,2,3a,4-tetrazaindene-7-thiol
M-15 2,4,6-trimercapto-1,3,5-triazine
M-16 4,6-dimercapto-5-aminopyrimidine
M-17 6-hydroxy-2-mercapto-4-methylpyrimidine
M-18 3-amino-6-keto-4-methyl-1-phenyl-2-thiono-1,2,3,6-tetrahydropyrimidine
M-19 2,4,6-trithiouramil
M-20 2-mercaptobenzimidazole
M-21 4-aminomethyl-2-mercaptoimidazole
M-22 1-methyl-2-mercaptoimidazole
M-23 2-mercapto-5-methyl-4H,1,3,4-thiadiazine
M-24 3,4-diphenyl-5-mercapto-1,2,4-triazole
M-25 5-amino-3-mercapto-1,2,4-triazole
M-26 3-β-formamidoethyl-5-mercapto-1,2,4-triazole
M-27 3-mercapto-1,2,4-triazole
M-28 2-mercapto-5-(m-tolyl)-1,3,4-oxadiazole
M-29 2-mercapto-5-(o-methoxyphenyl)-1,,3,4-oxadiazole
M-30 2-mercapto-5-(p-nitrophenyl)-1,3,4-oxadiazole
M-31 2-mercapto-β-naphthosazole
M-32 2-mercaptobenzoxazole
M-33 2-mercaptobenzothiazole
M-34 2-mercapto-4-phenylthiazole
M-35 2-mercapto-4-methyl-5-nitro-1,3-thiazole
M-36 2-(acetylthioglycolic amido)-benzothiazole
M-37 1-mercapto-phthalazine The quaternary ammonium salt and the silver salt of the heterocyclic mercaptan are positioned within the photographic element to modify the image tone produced in a photographic silver chlorobromide emulsion layer. In a preferred form, the quaternary ammonium salt and the silver salt are both incorporated in a layer of the photographic element adjacent the silver chlorobromide emulsion layer. The quaternary ammonium and silver salts can be located in a hydrophilic colloid layer lying adjacent the silver halide emulsion layer. The quaternary ammonium and silver salts are most preferably incorporated in an overcoat; that is, a layer which is more remote from the support of the photographic element that the silver chlorobromide emulsion layer. In a specific, preferred form the quaternary ammonium and silver salts are both located within a gelatin overcoat of the photographic element.

The photographic elements of this invention include at least one silver chlorobromide emulsion layer. The silver chlorobromide emulsions employed contain a high chloride content, preferably greater than 50 mole percent, based on total halide. The remaining halide present can be entirely bromide or bromide and iodide, up to about 5 mole percent iodide, based on total halide. The emulsions contain at least 5 mole percent bromide, based on total halide. The silver chlorobromide emulsions can contain silver chloride, silver bromide, silver chlorobromide (including silver chlorobromoiodide), silver chloroiodide, and similar silver halide crystals but are preferably comprised of silver chlorobromide crystals containing at least 50 percent chloride, based on total halide.

The emulsions can be coarse or fine grain emulsions and can be prepared by a variety of techniques, e.g., single jet emulsions such as those described in Trivelli and Smith, *The Photographic Journal*, Vol. LXXIX, May, 1939 (pp 330–338), double jet emulsions such as Lippmann emulsions, ammoniacal emulsions, thiocyanate or thioether ripened emulsions such as those described in Neitz et al. U.S. Pat. No. 2,222,264 issued Nov. 19, 1940; Illingsworth U.S. Pat. No. 3,320,069 issued May 16, 1967 and McBride U.S. Pat. No. 3,271,157 issued Sept. 6, 1966. The silver halide emulsions preferably form latent image predominantly on the surface of the silver halide grains. If desired, mixtures of such surface image-forming emulsions can be used. Silver halide emulsions can be regular grain emulsions such as the type described in Klein and Moisar, *J. Phot. Sci.*, Vol. 12, No. 5. Sept/Oct, 1964, pp 242–251 and German Pat. No. 2,107,118. Negative type emulsions can be used, as well as direct positive emulsions such as those described in Leermakers U.S. Pat. No. 2,184,013 issued Dec. 19, 1939; Kendall et al. U.S. Pat. No. 2,541,472 issued Feb. 13, 1951; Schouwenaars British Pat. No. 723,019 issued Feb. 2, 1955; Illingsworth et al. French Pat. No. 1,520,821 issued Mar. 4, 1968; Illingsworth U.S. Pat. No. 3,501,307 issued Mar. 17, 1970; Ives U.S. Pat. No. 2,563,785 issued Aug. 7, 1951; Knott et al. U.S. Pat. No. 2,456,953 issued Dec. 21, 1948 and Land U.S. Pat. No. 3,861,885 issued Nov. 25, 1958.

The silver chlorobromide emulsion layers as well as any separate quaternary ammonium salt and heterocyclic mercaptan silver salt containing layers preferably include a vehicle, such as the various colloids employed alone and in combination as vehicles in photographic elements.

Suitable hydrophilic vehicle matrials include both naturally-occurring substances such as proteins, for example, gelatin, gelatin derivatives, cellulose derivatives, polysaccharides such as dextran, gum arabic and the like; and synthetic polymeric substances such as water soluble polyvinyl compounds like poly(vinylpyrrolidone), acrylamide polymers and the like.

These layers can also contain alone or in combination with hydrophilic, water-permeable colloids, other synthetic polymeric vehicle compounds such as dispersed vinyl compounds such as in latex form and particularly those which increase the dimensional stability of the photographic materials. Typical synthetic polymers include those described in Nottorf U.S. Pat. No. 3,142,568 issued July 28, 1964; White U.S. Pat. No. 3,193,386 issued July 6, 1965; Houck et al. U.S. Pat. No. 3,062,674 issued Nov. 6, 1962; Houck et al. U.S. Pat. No. 3,220,844 issued Nov. 30, 1965; Ream et al. U.S. Pat. No. 3,287,289 issued Nov. 22, 1966; and Dykstra U.S. Pat. No. 3,411,911 issued Nov. 19, 1968. Other vehicle materials include those water-insoluble polymers of alkyl acrylates and methacrylates, acrylic acid, sulfoalkyl acrylates or methacrylates, those which have crosslinking sites which facilitate hardening or curing as described in Smith U.S. Pat. No. 3,488,708 issued Jan. 6, 1970, and those having recurring sulfobetaine units as described in Dykstra Canadian Pat. No. 774,054.

The silver chlorobromide emulsion layer or an adjacent layer include at least one conventional silver halide developing agent of a type heretofore employed in photographic elements processed in activator and stabilizer baths. Such developing agents include, for example, polyhydroxybenzenes such as hydroquinone developing agents including hydroquinone, alkyl-substituted hydroquinone, e.g., t-butylhydroquinone, methylhydroquinone, dimethylhydroquinone; catechol and pyrogallol; chlorosubstituted hydroquinones, such as chlorohydroquinone or dichlorohydroquinone; alkoxy-substituted hydroquinone such as methoxy or ethoxy hydroquinone; aminophenol developing agents, such as N-methyl-p-aminophenol and 2,4-diaminophenols including their acid salts; ascorbic acid developing agents; 3-pyrazolidone developing agents including those described in British Pat. No. 958,678 and British Pat. No. 930,572 such as 1-phenyl-3-pyrazolidone or 4,-dimethyl--lphenyl-3-pyrazolidone and acyl derivatives of p-aminophenols. Such developing agents can be used alone or in combination.

It is preferred to incorporate in the layer containing the developing agent a preservative such as an alkali metal bisulphite. Typical of specific preservatives which can be employed are sodium bisulphite and sodium formaldehyde bisulphite.

The silver chlorobromide emulsion layers additionally incorporate at least one azaindene antifoggant (or stabilizer). The azaindene can be chosen from among conventional azaindene antifoggants, such as, for example, those disclosed in British Pat. Nos. 748,745; 752,030; 755,369; 757,653; 814,823 and 815,075. Exemplary preferred azaindences include those such as A-1 4-hydroxt-6-methyl-1,,3,3a,7-tetraazaindene
A-2 5-carboxy-4-hydroxy-1,3,3a,7-tetraazaindene
A-3 1,2-bis(4-hydroxy-6-methyl-1,3,3a,7-tetraazaindene-5-yl)ethane
A-4 1,2,3,4-tetrakis(4-hydroxy-6-methyl-1,3,3a,7-tetraazaindene-2-yl)butane A-5 2-amino-5-carboxy-4-hydroxy-1,3,3a,7-tetraazaindene
A-6 4-hydroxy-2-β--hydroxyethyl-6-methyl-1,3,3a,7-tetraazindene
A-7 5-carbethoxy-4-hydroxyethyl-1,3,3a,7-tetraazaindene
A-8 7-hydroxy-1,2,3,4,6-pentaazaindene
A-9 4-hydroxy-2-γ-hydroxypropyl-6-methyl-1,3,3a,7-tetraazaindene
A-10 4-hydroxy-2(4-pyridyl)-6-methyl-1,3,3a,7-tetraazaindene
A-11 2-carboxy-4-hydroxy-6-methyl-1,3,3a,7-tetraazaindene
A-12 4-hydroxy-6-methyl-1,2,3,3a,7-tetraazaindene
A-13 4-hydroxy-5-ethyl-6-methyl-1,3,3a,7-tetraazaindene
A-14 2,4-dihydroxy-6-methyl-1,3a,7-triazaindene The azaindene antifoggants can be employed in combination with other conventional stabilizers and antifoggants. These include (a) thiazolium salts described in Brooker et al. U.S. Pat. No. 2,131,038 issued Sept. 27, 1938 and Allen et al. U.S. Pat. No. 2,694,716 issued Nov. 16, 1954; (*b*) the mercury salts as described in Allen et al. U.S. Pat. No. 2,728,663 issued Dec. 27, 1955; (*c*) the urazoles described in Anderson et al. U.S. Pat. No. 3,287,135 issued Nov. 22, 1966; (*d*) the sulfocatechols described in Kennard et al. U.S. Pat. No. 3,237,652 issued Feb. 22, 1966; (*e*) the oximes described in Carroll et al. British Pat. No. 623,448 issued May 18, 1949; (*f*) nitron; (*g*) nitroindazoles; (*h*) the mercaptotetrazoles described in Kendall et al. U.S. Pat. No. 2,403,927 issued July 16, 1946; Kennard et al. U.S. Pat. No. 2,266,897 issued Aug. 16, 1966; and Luckey et al. U.S. Pat. No. 3,397,987 issued Aug. 20, 1968; (*i*) the polyvalent metal salts described in Jones U.S. Pat. No. 2,839,405 issued June 17, 1958; (*j*) the thiuronium salts described in Herz et al. U.S. Pat. No. 3,220,839 issued Nov. 30, 1965; and (*k*) the palladium, platinum and gold salts described in Trivelli et al. U.S. Pat. No. 2,566,263 issued Aug. 28, 1951; and Yutzy et al. U.S. Pat. No. 2,597,915 issued May 27, 1952.

The silver chlorobromide emulsion layers can be sensitized with chemical sensitizers, such as with: reducing; sulfur, selenium or tellurium compounds; gold, platinum or palladium compounds, or combinations or these. Procedures for chemically sensitizing silver halide emulsions are described in Sheppard et al. U.S. Pat. No. 1,623,499 issued Apr. 5, 1927; Waller et al. U.S. Pat. No. 2,399,083 issued Apr. 23, 1946; McVeigh U.S. Pat. No. 3,297,447 issued Jan. 10, 1967 and Dunn U.S. Pat. No. 3,297,446 issued Jan. 10, 1967.

If desired, the silver chlorobromide emulsion layer can also be orthochromatically or panchromatically sensitized using conventional spectral sensitizing dyes, such as those disclosed in paragraph XV, *Product Licensing Index*, Vol. 92, December 1971, publication 9232. Other conventional emulsion addenda, such as disclosed in additional paragraphs of the above publication, can also be incorporated within the silver chlorobromide emulsion layer.

The photographic and other hardenable layers, particularly gelatin-containing layers, used in the present photographic elements can be hardened by various organic or inorganic hardeners, alone or in combination, such as those disclosed in Mees and James, *The Theory of the Photographic Process*, pp. 54–60, 3rd Edition, MacMillan. Typical useful hardeners include the aldehydes, and blocked aldehydes as described in Allen et al. U.S. Pat. No. 3,232,764 issued Feb. 1, 1966; ketones, carboxylic and carbonic acid derivatives; sulfonate esters; sulfonyl halides; vinyl sulfonyl ethers as described in Burness et al. U.S. Pat. No. 3,539,644 issued Nov. 10, 1970; active halogen compounds; epoxy compounds, aziridines; active olefins; isocyanates; carbodiimides; chlorotriazines as disclosed in Yamamoto et al. U.S. Pat. No. 3,325,287 issued June 13, 1967, Oishi et al. U.S. Pat. No. 3,362,827 issued Jan. 9, 1968, Nishio et al. U.S. Pat. No. 3,394,006 issued July 23, 1968 and Meckl et al. U.S. Pat. No. 3,549,377 issued Dec. 22, 1970; polymeric hardeners such as oxidized polysaccharides like dialdehyde starch and oxyguargum; and the like.

To permit viewable photographic prints to be obtained by rapid processing techniques the photographic elements of this invention employ reflective, non-porous supports. Typically the supports are white in appearance; that is, they are reflective throughout the visible spectrum. Any photographic support material capable of yielding non-porous supports can be employed. One specifically contemplated type of reflective, non-porous support is a flexible paper support which has been coated with an alpha-olefin polymer, particularly a polymer of an alpha-olefin containing 2 to 10 carbon atoms such as polyethylene, polypropylene, ethylenebutane copolymers and the like. In another form the support can be of a reflective polymeric type. For example, a photographic film support having a reflective coating thereon can be employed. Alternately, the polymeric support can be chosen of a composition which is reflective throughout, such as a crystalline polypropylene or propylene-α-olefin copolymer of the type disclosed in British Pat. No. 1,348,839. Where a resin coated paper support is employed, it can, of course, be partially acetylated or coated with a baryta layer or with pigment such as titanium dioxide or zinc oxide can be incorporated in the resin layer according to conventional practice.

In one form a photographic element according to this invention can be comprised of a polyethylene coated paper support having coated thereon a gelatino-silver chlorobromide emulsion layer containing an incorporated developing agent and an azaindene antifoggant. The silver chlorobromide emulsion layer is orthochromatically sensitized and is overcoated with a transparent gelatin layer containing a mixture of the quaternary ammonium salt and the silver salt of the heterocyclic mercaptan.

While the optimum concentration levels of the various components of the photographic elements are generally known in the art and are recognized to depend upon a variety of parameters including such diverse factors as the sensitometric properties desired, the conditions of exposure and processing contemplated, the speed with which a fully processed print is to be obtained, the processing chemicals employed and the like, improved image tones can be achieved by employing the quaternary salts of this invention in concentrations of from 0.5 to 5 mg/0.1 meter$^2$, most preferably from 1 to 3 mg/0.1 meter$^2$ in combination with silver salts of at least one heterocyclic mercaptan in concentrations of from 1 to 10.0 mg/0.1 meter$^2$, most preferably 2 to 5.0 mg/0.1 meter$^2$. The azaindene concentration can be within the range of from 1 to 20 grams per mole of silver chlorobromide, most preferably from 3 to 15 grams per mole of silver chlorobromide. The developing agent can be present in an amount of from 50 to 200 mg per 0.1 meter², preferably 80 to 120 mg per 0.1 meter². Where the processing solutions contain some developing agent, lower amounts of developing agent can be incorporated.

The photographic elements of this invention can be processed successively in an alkaline activator bath and a stabilizer bath to form a warm tone, continuous tone photographic print. The activator bath is typically an aqueous alkaline bath which when brought into contact with the developing agent incorporated within the photographic element forms a photographic developer solution. The activator bath can contain the ordinary addenda of a photographic developer other than the developing agent itself, such as preservatives and the like. The stabilizer bath is typically an aqueous acid bath which spots development of the photographic element and contains a compound, such as a water soluble thiocyanate which reacts with the silver halide in the photographic element to form a product which is less radiation-sensitive. An exemplary activator bath is shown in British Pat. No. 1,139,063, cited above, to be formed of 50 grams sodium hydroxide, 30 grams sodium sulphite and water to 1 liter. The same patent discloses an exemplary stabilizer bath to be comprised of 300 grams ammonium thiocyanate, 50 grams potassium metabisulphite, 15 grams sodium sulphite, 40 ml glacial acetic acid, 15 grams disodium hydrogen phosphate and water to 1 liter.

Instead of processing the photographic element of this invention in an activator bath and a stabilizer bath, processing can alternatively be undertaken in a conventional developer containing a silver halide developing agent. That is, the photographic element will produce desirably warm image tones also when processed following exposure in a developer, a stop bath and a fixing bath, following conventional black-and-white photographic processing techniques.

A number of experiments were carried out to illustrate the invention.

A silver chlorobromoiodide (59:40:1 mole ratio) emulsion was prepared using the "double-jet" technique. An aqueous solution of potassium bromide, potassium chloride and potassium iodide; an aqueous solution of silver nitrate and an aqeuous solution of rhodium ammonium chloride (0.15 milligram/silver halide mole) were added to an aqueous gelation solution at 65° C with rapid stirring. The emulsion was washed to remove the insoluble salts and chemically sensitized in the conventional manner. To the emulsion was added an azaindene antifoggant. To the emulsion was also added 100 mg per 0.1 meter² hydroquinone as the incorporated developing agent and sodium formaldehyde bisulphite as a preservative. The emulsion was coated on a polyethylene resin coated paper support. The tone modifying agents were then coated in a gelatin layer over the emulsion layer. This procedure was used to form each photographic element discussed below. Variations in ingredients and concentrations are specifically noted below.

Each of the photographic elements noted below were identically exposed using an intensity scale sensitometer. Unless otherwise noted that photographic elements were processed successively in an activator bath and a stabilizer bath similar to that disclosed in British Pat. No. 1,139,063, cited above. The image tone of the photographic prints obtained was judged using the techniques disclosed by Walter H. Carnaham in a paper titled "Measuring the Image Tone of Photographic Paper", published in the Photographic Society of America Journal, Vol. 18, No. 3, March 1952. A warm image tone is observed when the reflectance at a wavelength of 460 nanometers is less than the control and the reflectance at a wavelength of 650 nanometers is greater than the control.

TABLE I

| Photographic Element | Antifoggant g/m | Tone Modifier (mg/ft²) | % Ref. at 460 | Δ Ref. | % Ref. at 650 | Δ Ref. |
|---|---|---|---|---|---|---|
| Control-1 | A-1 (11.4) | none | 15.7 | — | 16.9 | — |
| Control-2 | A-1 (11.4) | M-1 (3.5) | 15.4 | −0.3 | 16.8 | −0.1 |
| Control-3 | A-1 (11.4) | none | 16.7 | — | 14.9 | — |
| Control-4 | A-1 (11.4) | QS-16 (1.8) | 16.9 | +0.2 | 15.1 | +0.2 |
| Control-5 | A-1 (11.4) | QS-6 (1.8) | 16.6 | −0.1 | 15.1 | +0.2 |
| Control-6 | A-1 (11.4) | QS-18 (1.8) | 16.8 | +0.1 | 15.3 | +0.4 |
| Control-7 | A-1 (11.4) | none | 16.7 | — | 14.9 | — |
| Example-1 | A-1 (11.4) | QS-16 (1.8) + M-1 (3.5) | 16.4 | −0.3 | 15.9 | +1.0 |
| Example-2 | A-1 (11.4) | QS-6 (1.8) + M-1 (3.5) | 16.4 | −0.3 | 16.2 | +1.3 |
| Example-3 | A-1 (11.4) | QS-18 (1.8) + M-1 (3.5) | 16.8 | +0.1 | 15.5 | +0.6 |
| Control-8 | A-1 (11.4) | none | 16.2 | — | 16.3 | — |
| Control-9 | A-1 (11.4) | QS-16 (1.8) | 15.7 | −0.5 | 16.1 | −0.2 |
| Example-4 | A-1 (11.4) | QS-16 (1.8) + M-1 (3.5) | 14.0 | −1.3 | 16.6 | +0.3 |
| Control-10 | A-11 (11.4) | none | 15.3 | — | 16.6 | — |
| Control-11 | A-11 (11.4) | QS-16 (1.8) | 14.9 | −0.4 | 16.4 | −0.2 |
| Example-5 | A-11 (11.4) | QS-16 (1.8) + M-1 (3.5) | 14.8 | 0.5 | 16.6 | 0.0 |
| Control-12* | A-11 (11.4) | none | 14.4 | — | 17.5 | — |

*Processed with Kodak Developer D-72

The results show that combinations of quaternary ammonium salts and heterocyclic mercaptan silver salts as tone modifying agents produce warmer tones than are obtained in their absence. The results further show that warmer image tones are obtained whether the photographic element is processed in activator and stabilizer baths or in a conventional developer.

Another group of photographic elements were prepared, exposed and processed as generally described above, but with the following variations: The azaindene was incorporated in the emulsion layer at a concentration of 10.8 grams per mole of silver, the quaternary ammonium salt was incorporated at a concentration of 3.2 mg/0.1 meter² and the heterocyclic mercaptan silver salt was incorporated in the overcoat at a concentration of 1.7 mg/0.1 meter$^2$. One photographic element of each structure was processed with successive activator and stabilizer baths while another, identical photographic element was processed with Kodak Developer D-72. Results were evaluated in terms of image stability (i.e., fog), adequacy of development using the activator and stabilizer baths and image tone. The emulsions were evaluated using azaindenes A-1, A-11, A-12, A-13 and A-14; heterocyclic mercaptan silver salts M-1, M-33, M-34, M-35 and M-36; and quaternary ammonium salts QS-1, QS-6 and QS-15 through QS-25.

The results show that the incorporation of azaindene allows low fog levels to be maintained, but produces an unacceptably cold image tone and interferes somewhat with activator development. Using an azaindene in combination with the ammonium salt improves development without substantially lowering stability, but does not improve image tone. Using an azaindene in combination with a mercaptan silver salt does not cure the deficiencies of activator development or the image tone. Only by using the azaindene, the quaternary ammonium salt and the silver salt of the heterocyclic mercaptan in combination is an acceptable image tone, stability and activator developability obtained.

The invention has been described in detail with reference to certain preferred embodiments thereof, but it will be understood that variations and modifications can be effected within the spirit and scope of the invention.

We claim:

1. A photographic element containing an incorporated developing agent and which forms a warm image tone photographic print upon successive processing in an akaline activator bath and a stabilizer bath, said element comprising a white reflective non-porous support, a silver halide emulsion layer which forms a viewable continuous tone silver image therein upon processing, wherein said silver halide is comprised of greater than 50 mole percent chloride, up to 5 mole percent iodide and the remainder bromide based on total halide, said layer additionally containing from 1 to 20 grams per mole of silver halide of an azaindene antifoggant, and in said emulsion layer or in a layer adjacent thereto, a mixture of from 1 to 10 mg per 0.1 meter$^2$ of a quaternary ammonium salt and from 1 to 10 mg per 0.1 meter$^2$ of a silver salt of a heterocyclic mercaptan represented by the general formula

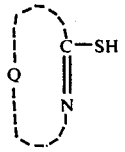

wherein

Q represents the atoms necessary to complete a five-or six-membered heterocyclic ring.

2. A photographic element according to claim 1 wherein said silver halide emulsion is a silver chlorobromoiodide emulsion.

3. A photographic element according to claim 1 wherein said incorporated silver halide developing agent is a hydroquinone developing agent.

4. A photographic element according to claim 1 wherein a bisulfite preservative is present with said incorporated developing agent.

5. A photographic element according to claim 1 wherein said azaindene antifoggant is a tetraazaindene antifoggant.

6. A photographic element according to claim 1 wherein said quaternary ammonium salt is an N-heterocyclic quaternary ammonium salt.

7. A photographic element according to claim 6 wherein said N-heterocyclic quaternary ammonium salt is chosen from the class of pyridyl, $\alpha$-picolyl, piperidyl and morpholinyl quaternary ammonium salts.

8. A photographic element according to claim 1 wherein said heterocyclic ring is a thiazole or tetrazole ring.

9. A photographic element according to claim 1 wherein said reflective non-porous support is a resin-coated paper support.

10. A photographic element according to claim 1 wherein said warm image tone providing mixture is present in an overcoat overlying said silver halide emulsion layer.

11. A multilayer photographic element which forms a warm image tone photographic print upon successive processing in an alkaline activator bath and a stabilizer bath following imagewise exposure comprising a resin-coated paper support, a silver halide emulsion layer which forms a viewable continuous tone silver image therein upon processing, wherein said silver halide is comprised of greater than 50 mole percent chloride, up to 5 mole percent iodide and the remainder bromide, based on total halide, said layer additionally containing from 1 to 20 grams per mole of silver halide of a tetraazaindene antifoggant, a layer located adjacent said emulsion layer comprising a mixture of 0.5 to 5.0 mg per 0.1 square meter of a pyridinium salt and from 1 to 10 mg per 0.1 square meter of a silver salt of a heterocyclic mercaptan represented by the general formula

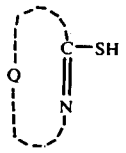

wherein Q represents the atoms necessary to complete a tetrazole or thiazole ring, and a hydroquinone developing agent located in at least one of said layers in an amount of from 50 to 200 mg per 0.1 squiare meter.

12. A photographic element according to claim 11 wherein said pyridinium salt is present in a concentration of from 1 to 3 mg per 0.1 meter$^2$.

13. A photographic element according to claim 11 wherein said pyridinium salt is chosen from the class consisting of decamethylene-$\alpha$-**-bis(oxymethylpyridinium perchlorate); hexadecylpyridinium chloride; tetradecamethylene-bis-(pyridinium perchlorate); 1,1'-bis pyridinium chloride; N,n'-ethylene bis-(oxymethyl pyridinium perchlorate; 7,14-diaza-6,15-dioxaeicosane-1,20-bis-(pyridinium perchlorate); 3,6,9,12,15,18,21,24-octaoxahexacosane bis-(pyridinium perchlorate); 7,18-diaza-6,19-dioxatetracosane-1,24-bis(pyridinium perchlorate); 3,6,9,12,15,18,24-octaoxahexacosane-1,26-bis(5-ethyl-2-methyl pyridinium methylsulfonate); 7,13-dithianonadecane-1,19-bis(pyridinium p-toluene sulfonate); 3,8-dithiadecane-1,10-bis(N-methyl piperidinium p-toluene sulfonate); 1,1'-ethylene-bis(- pyridinium perchlorate) and carboxydecane-1-pyridinium perchlorate.

14. A photographic element according to claim 11 wherein said tetrazaindene is present in a concentration of from 3 to 15 gram per mole of silver halide.

15. A photographic element according to claim 14 wherein said tetrazaindene is chosen from the group consisting of 4-hydroxy-6-methyl-1,3,3a,7-tetraazaindene; 2-carboxy-4-hydroxy-6-methyl-1,3,3a,7-tetraazaindene; 4-hydroxy-6-methyl-1,2,3,3a,7-tetraazindene; 4-hydroxy-5-ethyl-6-methyl-1,3,3a,7-tetrazaindene and 2,4-dihydroxy-6-methyl-1,3a,7-tetraazaindene.

16. A photographic element according to claim 11 wherein said silver salt of a mercaptotetrazole or mercaptothiazole is chosen from the group consisting of 1-phenyl-5-mercaptotetrazole; 2-mercaptobenzothiazole; 2-mercapto-4-phenylthiazole; 2-mercapto-4-methyl-5-nitro-1,3-thiazole and 2-(acetylthioglycolic amido)benzothiazole.

* * * * *

UNITED STATES PATENT AND TRADEMARK OFFICE

CERTIFICATE OF CORRECTION

PATENT NO. : 4,013,470

DATED : March 22, 1977

INVENTOR(S) : John T. Landon, Jr.

It is certified that error appears in the above-identified patent and that said Letters Patent are hereby corrected as shown below:

Column 12,
line 55, that part of formula reading "α-**" should read --α-ω--; line 58, that part of formula reading "1,1'-bis" should read --1,1'-[ethylene bis-(oxymethylene)]-bis--; line 58, that part of formula reading "N,n'" should read --N,N'--. Column 13, last line, and column 14, first line, "4-hydroxy-6-methyl-1,2,3,3a,7-tetraazindene" should read --4-hydroxy-6-methyl-1,2,3,3a,7-tetraazaindene--. Column 14, lines 1-2, "4-hydroxy-5-ethyl-6-methyl-1,3,3a,7-tetrazaindene" should read --4-hydroxy-5-ethyl-6-methyl-1,3,3a,7-tetraazaindene--; lines 2-3, "2,4-dihydroxy-6-methyl-1,3a,7-tetraazaindene" should read --2,4-dihydroxy-6-methyl-1,3a,7-triazaindene--.

Signed and Sealed this

*Seventh* Day of *March 1978*

[SEAL]

*Attest:*

RUTH C. MASON
*Attesting Officer*

LUTRELLE F. PARKER
*Acting Commissioner of Patents and Trademarks*